US006840080B2

(12) United States Patent
Matsuzaki

(10) Patent No.: US 6,840,080 B2
(45) Date of Patent: Jan. 11, 2005

(54) PRESS-FORMING APPARATUS

(75) Inventor: Toyoaki Matsuzaki, Shizuoka-Ken (JP)

(73) Assignee: Xenesys Inc. (JP)

( * ) Notice: Subject to any disclaimer, the term of this patent is extended or adjusted under 35 U.S.C. 154(b) by 0 days.

(21) Appl. No.: 10/387,576

(22) Filed: Mar. 14, 2003

(65) Prior Publication Data

US 2003/0172709 A1 Sep. 18, 2003

(30) Foreign Application Priority Data

Mar. 18, 2002 (JP) ..... P2002-074366

(51) Int. Cl.[7] ..... B21D 13/02; B21D 53/04
(52) U.S. Cl. ..... 72/385; 72/384; 72/379.6
(58) Field of Search ..... 72/385, 384, 404, 72/379.6; 29/890.05, 727

(56) References Cited

U.S. PATENT DOCUMENTS

| | | | | |
|---|---|---|---|---|
| 3,307,387 A | * | 3/1967 | Lacey, Jr. et al. | 72/324 |
| 3,845,654 A | | 11/1974 | Fuller et al. | |
| 4,434,643 A | * | 3/1984 | Almqvist et al. | 72/379.6 |
| 4,635,462 A | * | 1/1987 | Bald | 72/385 |
| 4,989,440 A | * | 2/1991 | Sjogren | 72/385 |
| 5,937,519 A | | 8/1999 | Strand | |

FOREIGN PATENT DOCUMENTS

| | | |
|---|---|---|
| JP | 63183739 A | 7/1988 |
| JP | 05200450 A | 8/1993 |
| JP | 2001321835 A | 11/2001 |

OTHER PUBLICATIONS

European Search Report dated May 9, 2003.

* cited by examiner

*Primary Examiner*—Daniel C. Crane
(74) *Attorney, Agent, or Firm*—Ronald P. Kananen; Rader, Fishman & Grauer PLLC

(57) ABSTRACT

A press-forming apparatus comprises a pair of press-forming units detachably secured to movable and stationary units facing each other, respectively. A metallic material is subjected to a press-forming through the press-forming units and then discharged therefrom as a heat transfer member for a heat exchanger. Each of the press-forming units comprises (i) a main forming section for forming on the material a heat transfer face with a corrugated portion, (ii) a pair of first subsidiary forming sections disposed on upstream and downstream sides of the main forming section so as to be adjacent thereto in the feeding direction of the material and (iii) a forming section-support base member detachably supporting the main forming section and the first subsidiary forming sections. The main forming section has a press-forming face with main corrugation patterned portions that are symmetric with respect to a central line perpendicular to the feeding direction of the material, and boundary patterned portions, on which recesses and projections align in a direction perpendicular to the feeding direction of the material. The first subsidiary forming sections of one of the pair of press-forming units is adjustable to shift press-forming faces thereof along a pressing direction, so as to provide switchably a contact mode in which the press-forming faces come into contact with the material together with the main forming section to apply a press-forming operation to the material and a non-contact mode in which the press-forming operation is not applied thereto.

11 Claims, 9 Drawing Sheets

PRESS-FORMING APPARATUS

BACKGROUND OF THE INVENTION

1. Field of the Invention

The present invention relates a press-forming apparatus for subjecting a material to a press-forming to provide a heat transfer member for a heat exchanger, and particularly to such an apparatus which permits formation of a plurality of press-formed portions as aligned on the material through the press-forming steps utilizing a plurality of forming sections.

2. Description of the Related Art

If there is a wish that heat transfer coefficient is increased to enhance heat exchange effectiveness, utilizing a heat exchanger by which heat exchange is made between a high temperature fluid and a low temperature fluid, a plate-type heat exchanger has conventionally been used widely. The plate-type heat exchanger has a structure in which a plurality of heat transfer members having a plate-shape are placed in parallel to one upon another at prescribed intervals so as to form passages, which are separated by means of the respective heat transfer member. A high temperature fluid and a low temperature fluid flow alternately in the above-mentioned passages to provide a heat exchange through the respective heat transfer members.

In general, the heat transfer member used in the conventional plate-type heat exchanger has a predetermined pattern of corrugations, which serves as a heat transfer face having the opposite surfaces with which heat exchange fluids are to come into contact. Such a pattern of corrugations causes turbulence in the fluids to improve the heat transfer efficiency, increases the heat transfer area and enhances the strength of the plate.

The heat transfer member having such a pattern of corrugations is generally formed of a metallic sheet. The metallic sheet is press-formed into a prescribed shape, thus providing a finished product, which is to be put into practice. The conventional press-forming apparatus utilizes a pair of metallic dies. More specifically, the material to be press-formed is held between the dies. Moving the dies closely to each other causes formation of a pattern of corrugations serving as the heat transfer face and the other press-formed portions on the metallic thin sheet of the material to be press-formed.

The press-forming operation for the heat transfer member has conventionally been carried out in this manner. The pair of dies forms the pattern of irregularities of the whole heat transfer member. It is therefore impossible to form any pattern of corrugations having a size larger than the molds. As a result, there is a restriction that the size of the heat transfer member depends on the size of the dies, thus making it impossible to manufacture the heat transfer member having a large area, due to limitation of the size of the dies.

In addition, the dies of the press-forming apparatus give the material to be press-formed a various kind of corrugations. When the pitch of the pattern of corrugations is not uniform so that the pitch on the one end side is small, but the pitch on the other side is large, conditions in the drawing of the material from the non-pressed portion to the pressed portion are different in the respective patterns of corrugations. A serious residual strain occurs in the press-formed portion and the non-pressed portion of the heat transfer member after completion of the press-forming step. As a result, the heat transfer member may curve partially or over the entirety, or be deformed, thus causing problems.

SUMMARY OF THE INVENTION

An object of the present invention, which was made to solve the above-mentioned problems, is therefore to provide a press-forming apparatus in which a forming section includes a plurality of dies that is selectively applicable, the press-forming steps are applied to the material to be press-formed with the use of selected dies so as to form patterns of corrugations in an appropriate aligned state, thus providing a proper shape over the entirety of the heat transfer member, while preventing unfavorable curve or deformation thereof, and the pattern of corrugations can easily be formed even on the relatively long material to be press-formed to provide the heat transfer member having the larger size than the die itself.

In order to attain the aforementioned object, the press-forming apparatus of the first aspect of the present invention comprises a pair of press-forming units, which are detachably secured to a movable unit and a stationary unit that face each other, respectively, so that a metallic thin sheet material to be press-formed, which is supplied to the press-forming units in a predetermined feeding direction, subjected to a press-forming through the press-forming units and then discharged therefrom as a heat transfer member for a heat exchanger, said heat transfer member having a predetermined shape, wherein:

each of said press-forming units comprises (i) a main forming section for forming on the material to be press-formed a heat transfer face with a corrugated portion, which has opposite surfaces to be brought into contact with heat exchange fluids, (ii) a pair of first subsidiary forming sections, which are disposed on upstream and downstream sides of said main forming section so as to be adjacent thereto in the feeding direction of the material to be press-formed, said pair of first subsidiary forming sections of one of said press-forming units respectively facing said pair of first subsidiary forming sections of another of said press-forming units to form an upstream set of first subsidiary forming sections and an downstream set of first subsidiary forming sections in the feeding direction of the material to be press-formed and (iii) a forming section-support base member detachably supporting said main forming section and said pair of first subsidiary forming sections;

said main forming section having a press-forming face on which there are formed main corrugation patterned portions that are symmetric with respect to a central line, which is perpendicular to the feeding direction of the material to be press-formed, on one hand, and boundary patterned portions having a predetermined width, on which a plurality of recesses and projections align in a direction perpendicular to the feeding direction of the material to be press-formed, on the other hand; and one of said upstream set of first subsidiary forming sections and one of said downstream set of first subsidiary forming sections being adjustable to shift press-forming faces thereof along a pressing direction, so as to provide switchably a contact mode in which said press-forming faces come into contact with the material to be press-formed together with the main forming section to apply a press-forming operation to the material to be press-formed and a non-contact mode in which the press-forming operation is not applied thereto.

According to the features of the first aspect of the present invention, the material to be press-formed is subjected to the press-forming step utilizing the main forming sections and the first subsidiary forming sections, which are aligned in the feeding direction of the material to be press-formed, to form the different patterns of corrugations on the material to be press-formed, thus providing a heat transfer member. Particularly, it is possible to form, as an occasion demands, flat portions or corrugations on the peripheral portion of the material to be press-formed so as to impart predetermined functions to the heat transfer member, thus providing the heat transfer members, which cope with many intended uses. Even when the material to be press-formed is relatively long, it is possible to apply the press-forming steps to the material to be press-formed, while selectively utilizing the first subsidiary forming sections, so as to form the heat transfer face and/or the other press-formed portions on the entirety of the heat transfer member, thus enabling the formation of the heat transfer face having the larger size of the die. The single press-forming step utilizing the main forming sections makes it possible to provide a state in which the press-formed portions with corrugations given by the boundary patterned portions, which are located in the front and rear sides in the feeding direction of the material to be press-formed, are aligned in the perpendicular direction to the feeding direction of the material to be press-formed. Accordingly, the end portions of the material to be press-formed can be provided with substantially the uniform press-forming conditions, irrespective of arrangement of the main corrugation pattern portion of the main member. Substantially the same condition in the drawing of the material from the non-pressed portion to the pressed portion is provided in the respective boundary between the pressed portion and the non-pressed portion, thus avoiding residual strain in any one of the pressed portion and the non-pressed portion of the heat transfer member after completion of the press-forming step. It is therefore possible to prevent an unfavorable deformation of the heat transfer member as the finished product, due to residual strain.

In the second aspect of the present invention, there may be adopted a structure in which each of said pair of main forming sections has a divided structure, which comprises a main member having on a surface thereof said main corrugated patterned portions and a pair of end members having on a surface thereof boundary patterned portions; said pair of end members of one of said pair of main forming sections are mounted on the forming section-support base member through predetermined resilient members so as to project from a press-forming face of said main member by a predetermined length in a state in which a pressing force is not applied to the material to be press-formed; and said resilient members have elasticity by which press-forming faces of said end members are retracted to a place corresponding to the press-forming face of the main member when a maximum pressing force is applied to the material to be press-formed.

According to the features of the second aspect of the present invention, each of the pair of main forming sections has the divided structure, which comprises the main member and the pair of end members, the end members of one of the pair of main forming sections are mounted on the forming section-support base member thorough the resilient members so as to come into contact with the material to be press-formed prior to the contact of the main member therewith, and the application of the maximum pressing force causes the main member and the end members to be urged on the material to be press-formed. It is therefore possible to bring the end members of the main forming section into initial contact with the material to be press-formed to hold the material in a proper position, thus providing a formation of the heat transfer face utilizing the main forming section with high accuracy.

In the third aspect of the present invention, the apparatus may further comprise: subsidiary forming section-elevating devices having a wedge-shape, which are disposed on the forming section-support base member on a rear side of said pair of first subsidiary forming sections in the pressing direction, so as to be movable in a horizontal direction, each of said subsidiary forming section-elevating devices having on a front side in the pressing direction an inclined surface having a predetermined inclination angle; and actuators for moving said subsidiary forming section-elevating devices in the horizontal direction, said one of said upstream set of first subsidiary forming sections and said one of said downstream set of first subsidiary forming sections being supported on the forming section-support base member so as to be adjusted along the pressing direction, each of said pair of first subsidiary forming sections being provided on an opposite surface to its press-forming face with an inclined surface having a same inclination angle as that of the inclined surface of said subsidiary forming section-elevating device.

According to the features of the third aspect of the present invention, the subsidiary forming section-elevating devices, which are provided on the front side in the pressing direction through the first subsidiary forming section with the inclined surface, are disposed so as to be movable in the horizontal direction, and sliding the subsidiary forming section-elevating device in the horizontal direction by the actuator, while bring them into contact with the first subsidiary forming section, enables the first subsidiary forming section to be shifted. The subsidiary forming section-elevating device having the wedge shape bears a strong force applied to the first subsidiary forming section during the press-forming operation so as to reduce a reaction force to be applied to the actuator. As a result, it is possible to lightening the load of the actuator more remarkably than the case where the actuator is disposed directly on the rear side in the pressing force. The actuator for shifting the fist subsidiary forming section can be made small-sized and inexpensive. In addition, no specific positional adjustment mechanism having a complicated structure is provided directly in the pressing direction, thus decreasing the whole height of the apparatus.

In the fourth aspect of the present invention, the apparatus may further comprise: a pair of second subsidiary forming sections for each of said pair of press-forming units, said secondary subsidiary forming sections being detachably disposed on opposite sides in a direction perpendicular to the feeding direction of the material to be press-formed on the forming section-support base member, so as to be adjacent to the main forming section, said pair of second subsidiary forming sections for one of said pair of press-forming units being mounted on the forming section-support base member through predetermined resilient members so as to project from the press-forming face of said main forming section by a predetermined length in a state in which a pressing force is not applied to the material to be press-formed; and said resilient members having elasticity by which press-forming faces of said second subsidiary forming sections are retracted to a place corresponding to the press-forming face of the main forming section when a maximum pressing force is applied to the material to be press-formed.

According to the features of the fourth aspect of the present invention, the secondary subsidiary forming sections are disposed on the opposite sides in the direction perpendicular to the feeding direction of the material to be press-formed on the forming section-support base member, so as to be adjacent to the main forming section, and the second subsidiary forming sections for one of the pair of press-forming units are mounted through the resilient members so as to project from the press-forming face of the main forming section so that the second subsidiary forming sections come into contact with the material to be press-formed prior to the contact of the main member therewith. In addition, the predetermined press-formed portions can be formed by the second subsidiary forming sections so as to align with the heat transfer face. It is therefore possible to provide the portions of the material to be press-formed in the perpendicular direction of the feeding direction of the material with desired functions, thus flexibly coping with many intended uses. It is possible to bring the second subsidiary forming sections into initial contact with the material to be press-formed to hold the material in a proper position, thus providing a formation of the heat transfer face utilizing the main forming section with high accuracy.

In the fifth aspect of the present invention, the apparatus may further comprise: suction support members being disposed in positions on an upstream side of the first subsidiary forming section on one of the forming section-support base members in the feeding direction of the material to be press-formed, so as to support, under a sucking operation, the material to be press-formed, which is supplied between the forming sections while keeping one end of the material to be press-formed in substantially the same level as the press-forming face of said main forming section.

According to the features of the fifth aspect of the present invention, the suction support members are disposed in the predetermined positions on the upstream side of the first subsidiary forming section on the forming section-support base member in the feeding direction of the material to be press-formed so as to hold the portion of the material to be press-formed, which extends from the dies upstream in the feeding direction of the material and has not as yet been subjected to the press-forming step, under the sucking action, even when the material to be press-formed is relatively long. The material to be press-formed can be kept stably and stationary, thus preventing the material from unfavorably moving, irrespective of release of the material from the carrying unit.

DETAILED DESCRIPTION OF THE PREFERRED EMBODIMENTS

Figure 1:
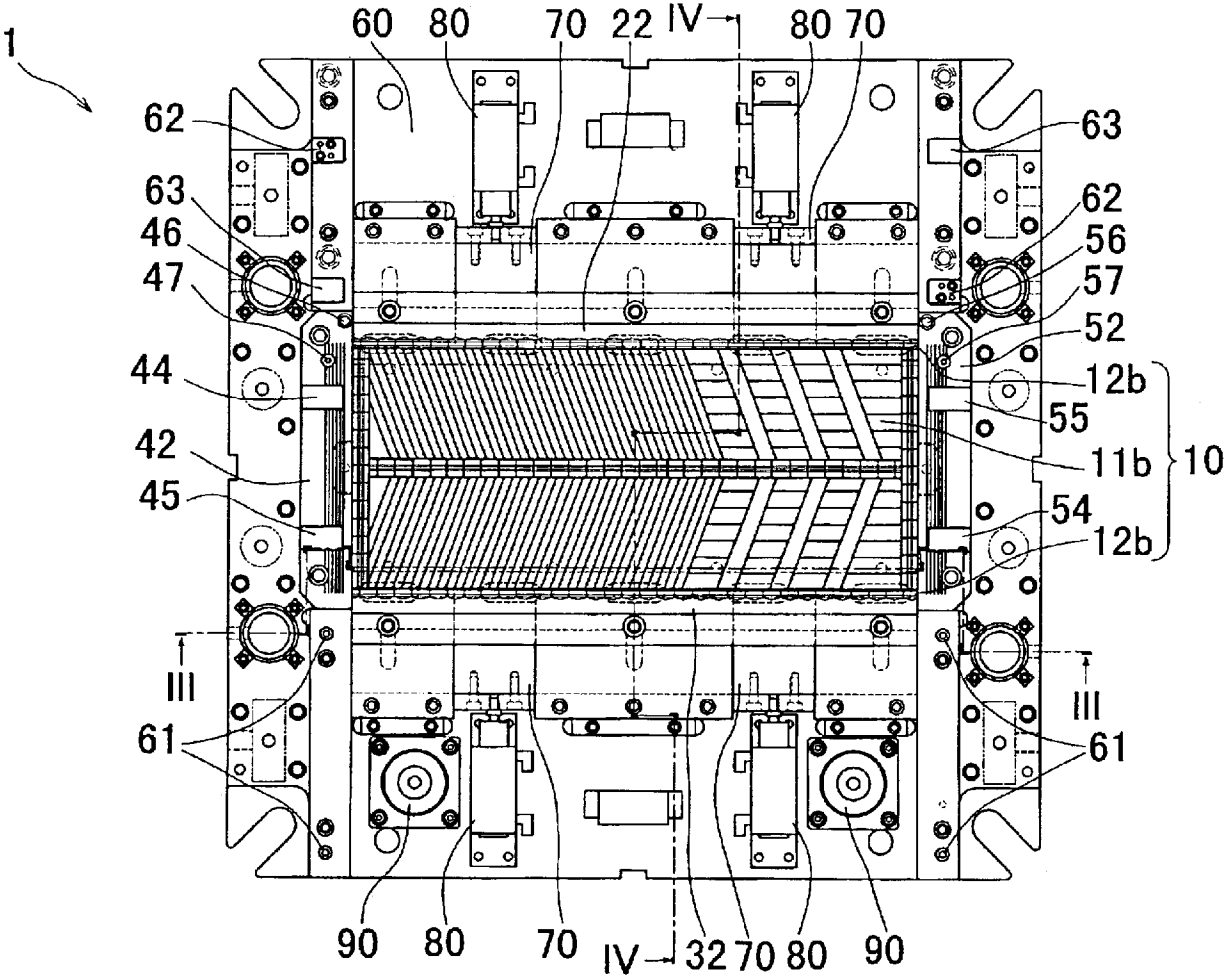
FIG. 1 is a plan view illustrating the lower press-forming unit of a press-forming apparatus according to an embodiment of the present invention.
Figure 2:
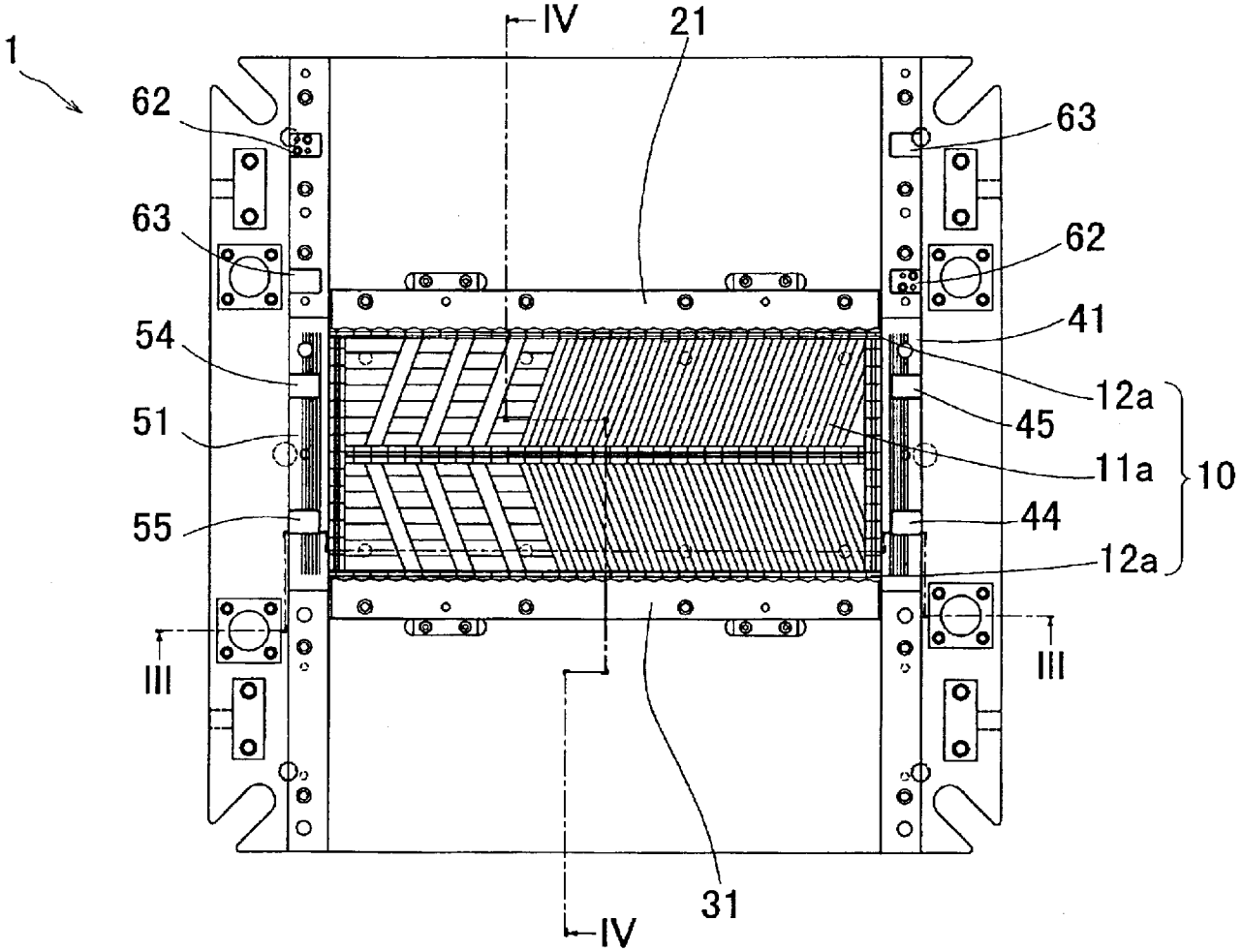
FIG. 2 is a bottom view illustrating the upper press-forming unit of the press-forming apparatus according to the embodiment of the present invention.
Figure 3:
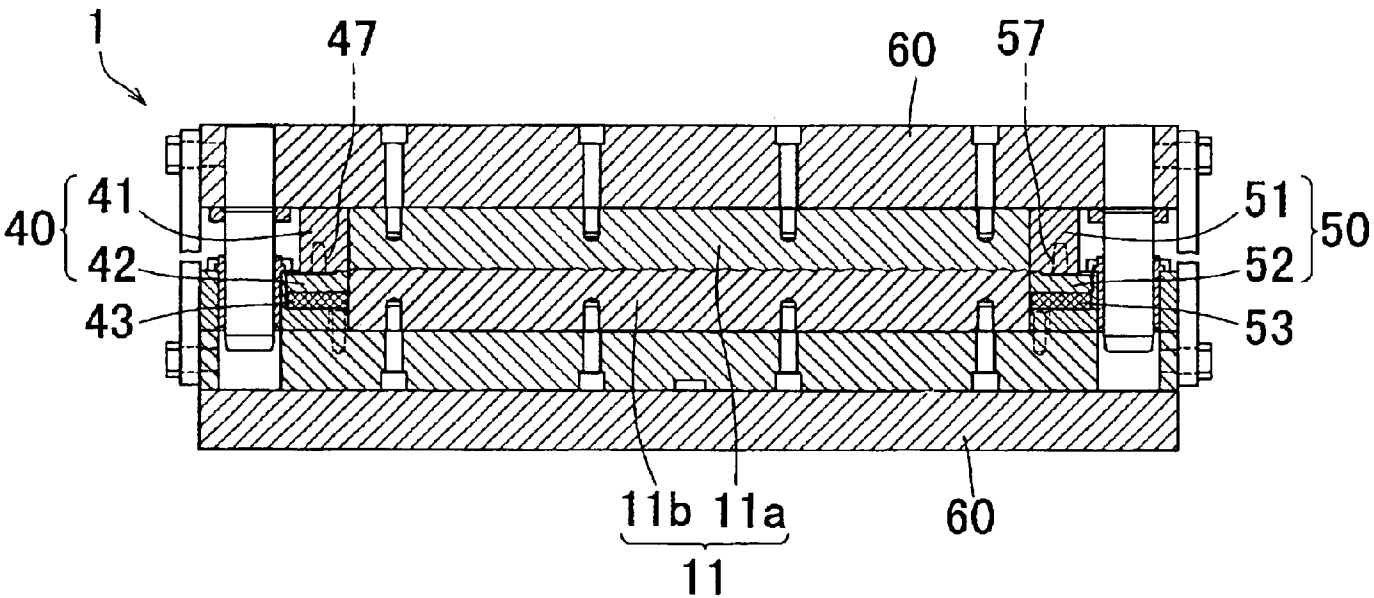
FIG. 3 is a cross-sectional view in which the cross-section of the lower press-forming unit cut along the line III—III as shown in FIG. 1 and the cross-section of the upper press-forming unit cut along the line III—III as shown in FIG. 2 are combined to each other.
Figure 4:
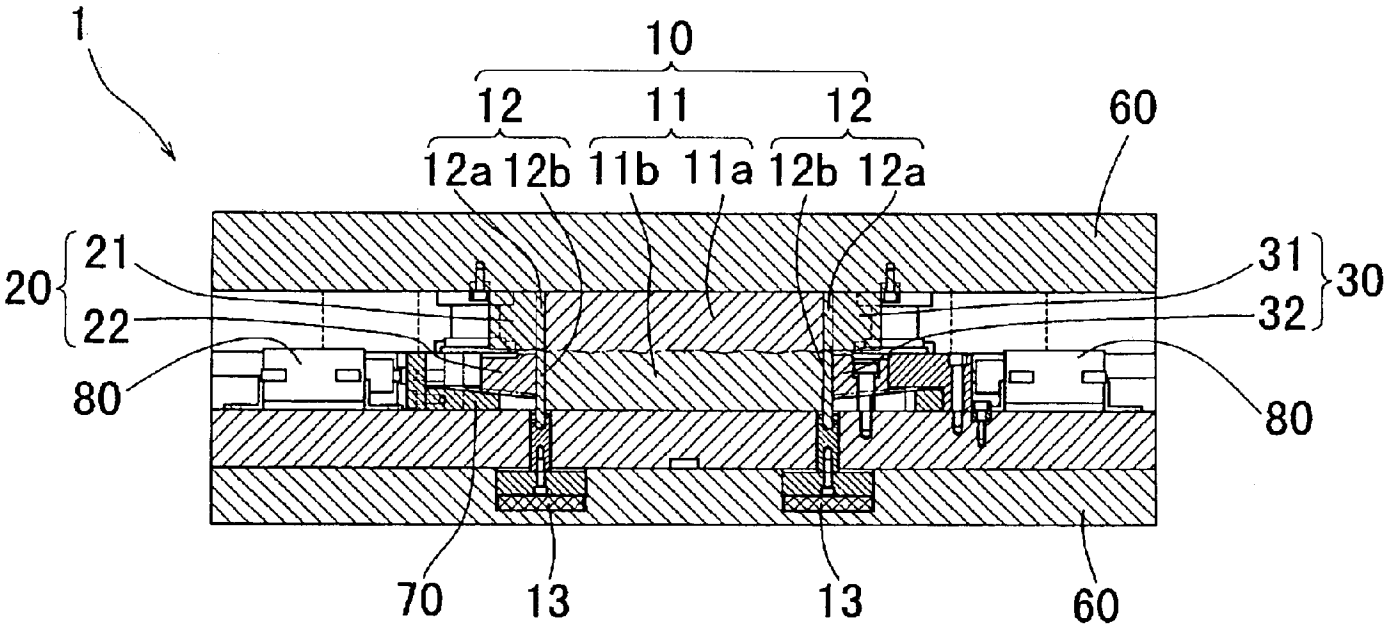
FIG. 4 is a cross-sectional view in which the cross-section of the lower press-forming unit cut along the line IV—IV as shown in FIG. 1 and the cross-section of the upper press-forming unit cut along the line IV—IV as shown in FIG. 2 are combined to each other.
Figure 5A:
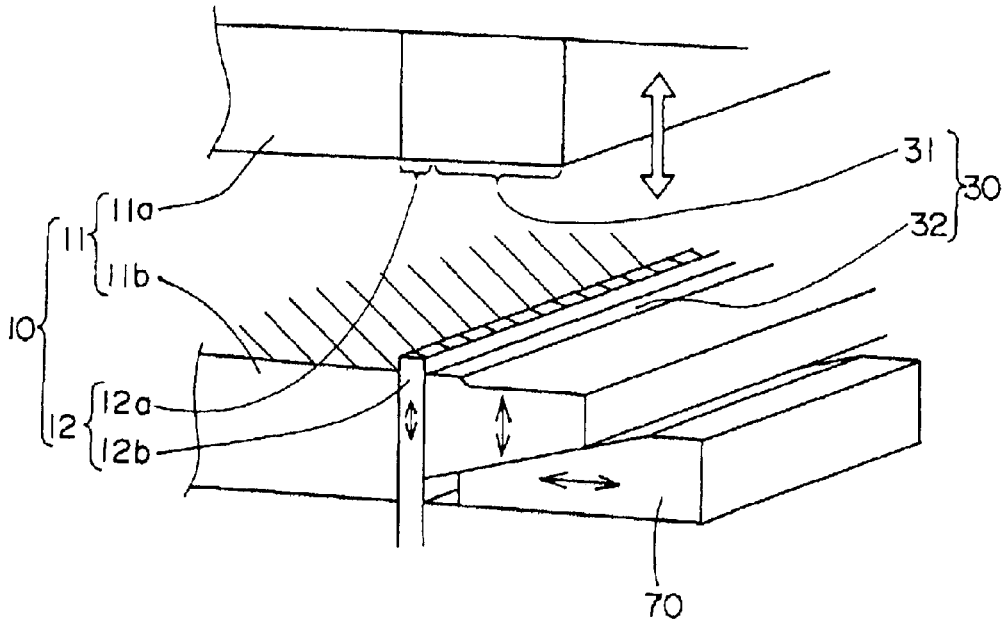
FIG. 5(A) is a schematic perspective view illustrating the structure of the first and second subsidiary forming sections of the press-forming apparatus according to the embodiment of the present invention and FIG. 5(B) is a schematic perspective view illustrating a mounting state of the lower forming section of the second subsidiary forming sections.
Figure 5B:
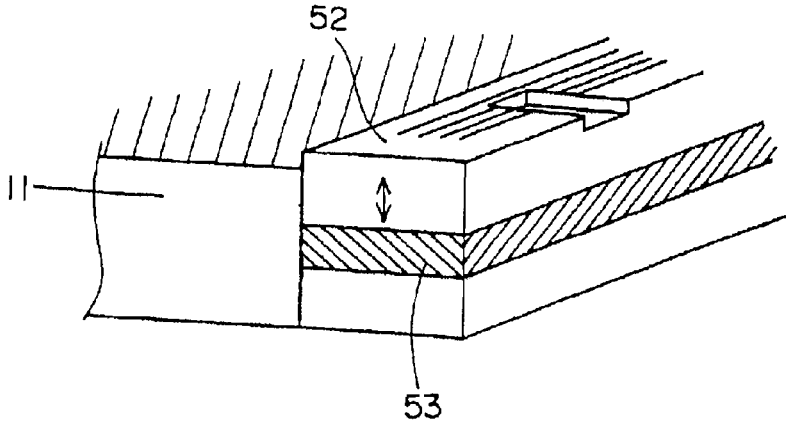
Figure 6A:
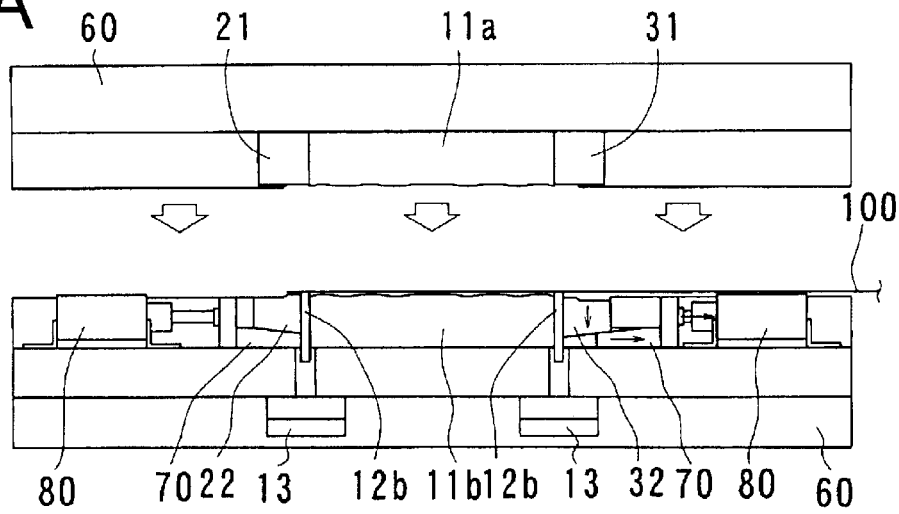
FIGS. 6(A) to 6(C) are descriptive views illustrating a press-forming operation, which is applied to an end area of the material to be press-formed through the press-forming apparatus according to the embodiment of the present invention.
Figure 6B:
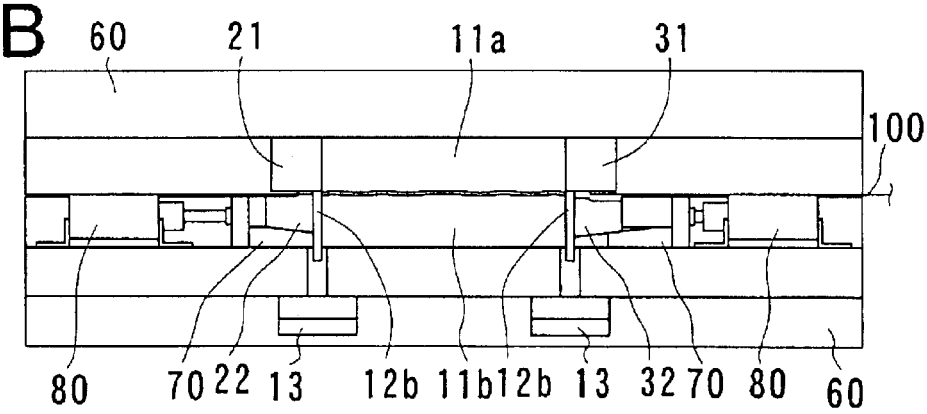
Figure 6C:
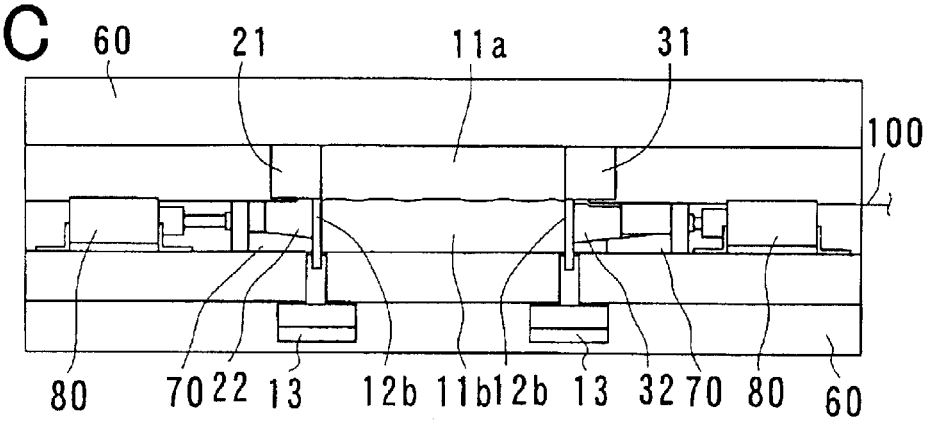
Figure 7A:
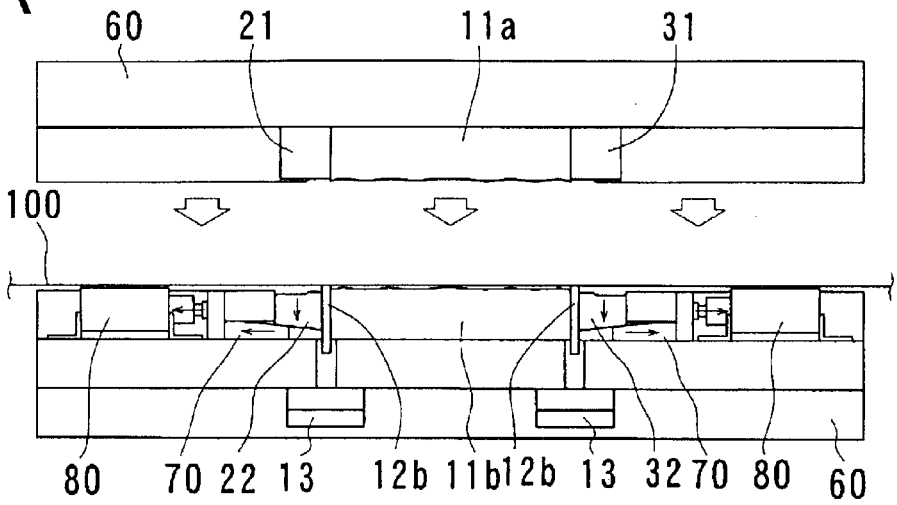
FIGS. 7(A) to 7(C) are descriptive views illustrating the press-forming operation, which is applied to a middle portion of the material to be press-formed through the press-forming apparatus according to the embodiment of the present invention.
Figure 7B:
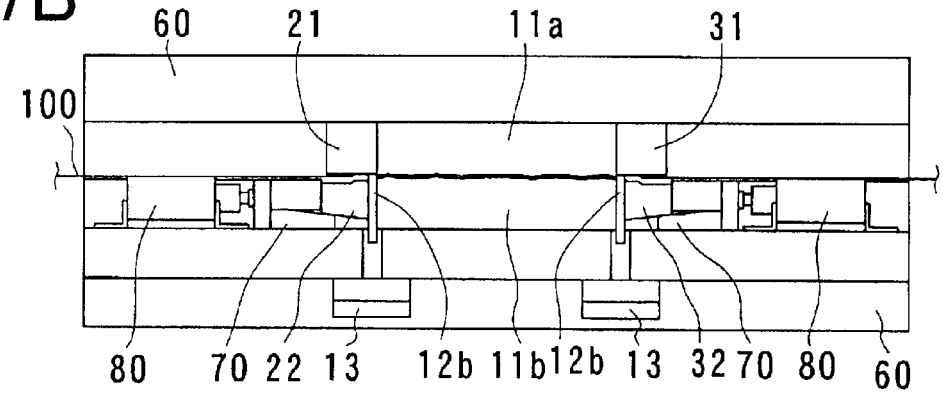
Figure 7C:
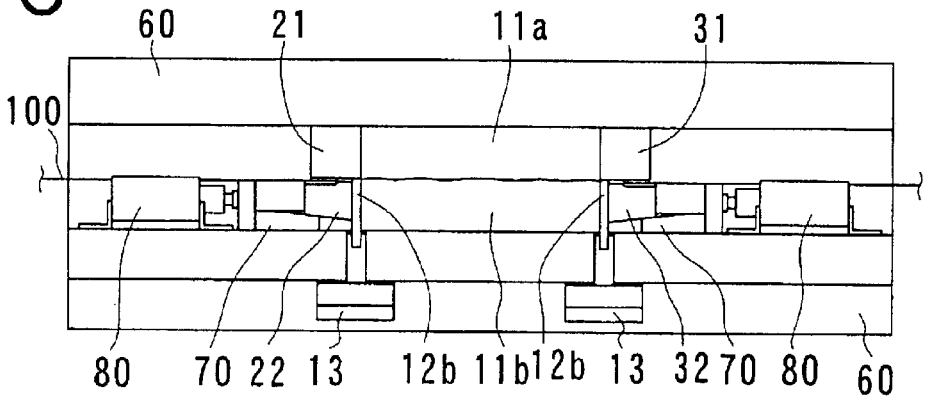
Figure 8A:
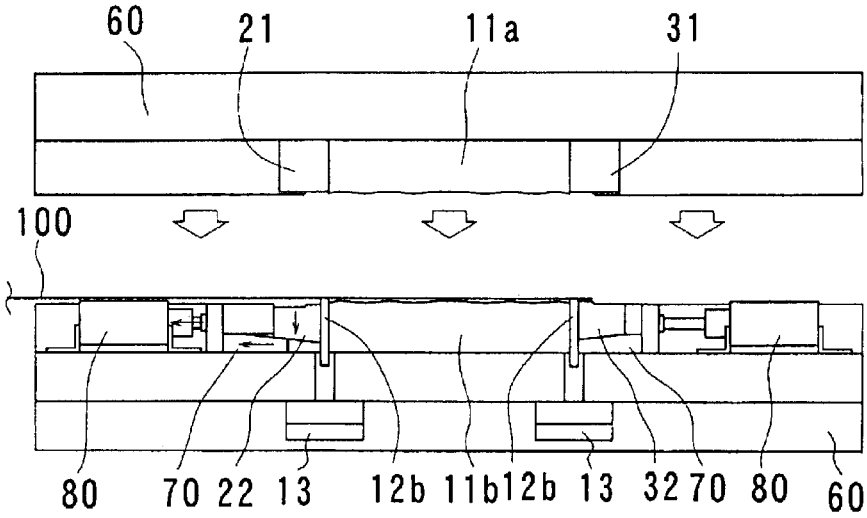
FIGS. 8(A) to 8(C) are descriptive views illustrating the press-forming operation, which is applied to the other end area of the material to be press-formed through the press-forming apparatus according to the embodiment of the present invention.
Figure 8B:
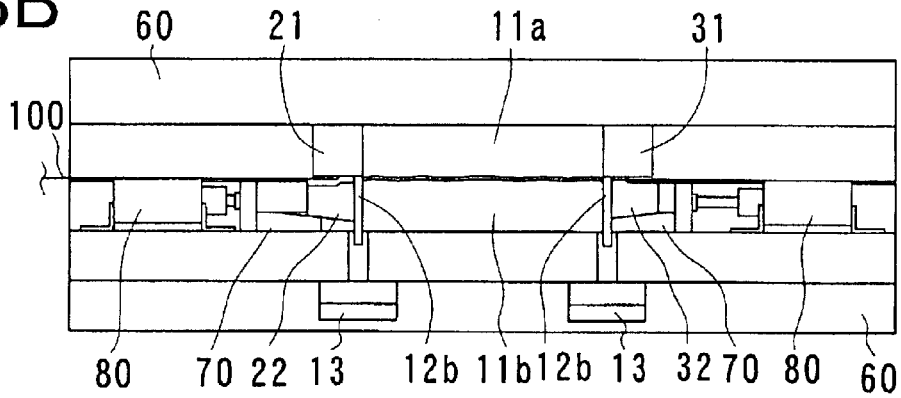
Figure 8C:
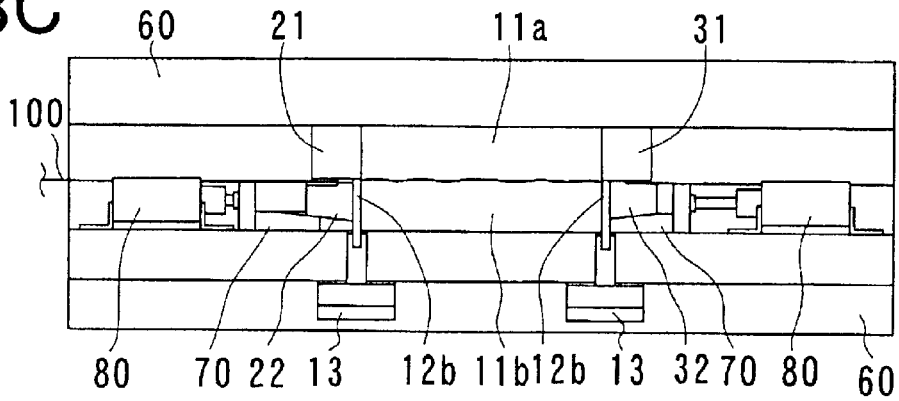
Figure 9:
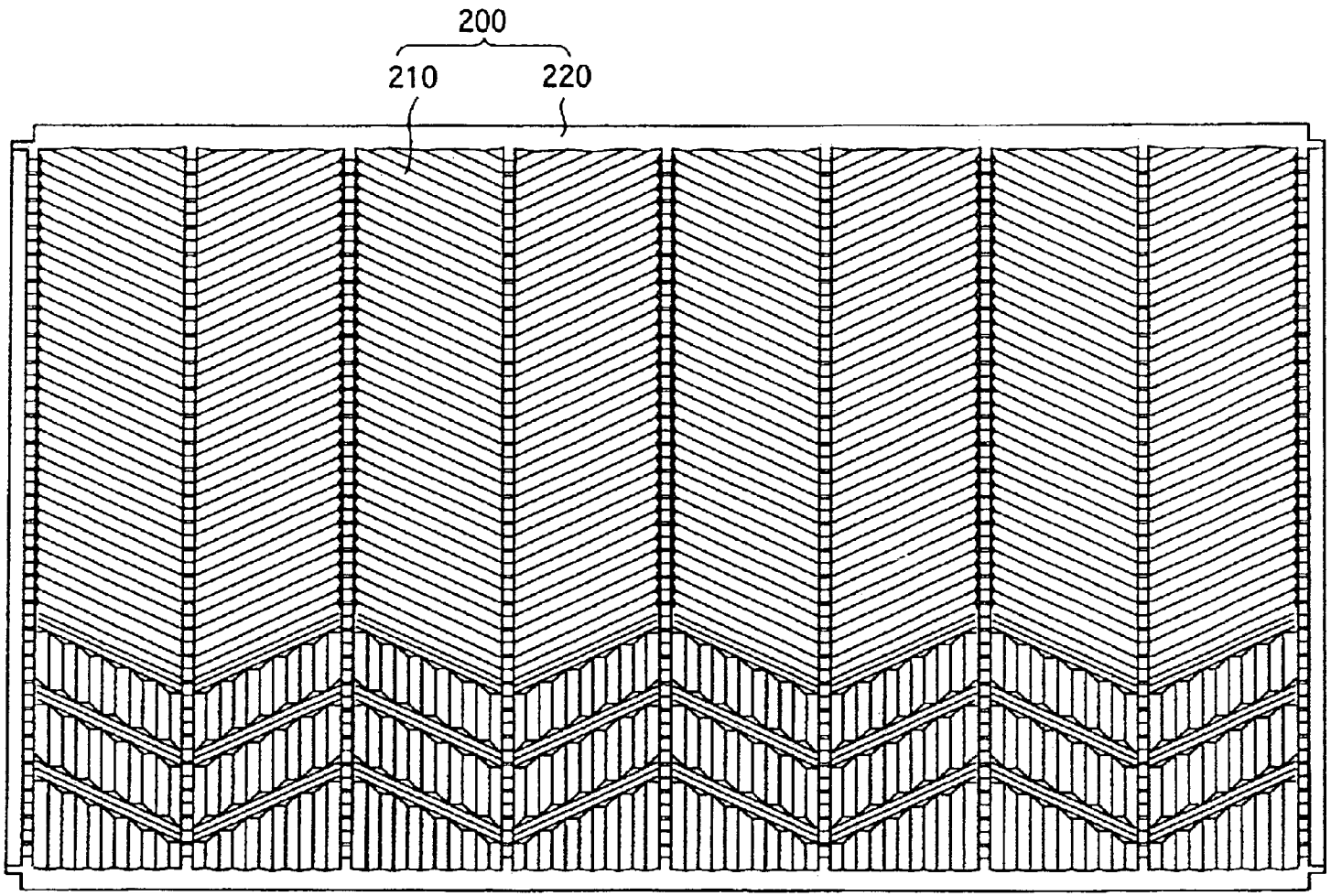
FIG. 9 is a schematic plan view of a heat transfer member, which is manufactured by the press-forming apparatus according to the embodiment of the present invention.

Now, embodiments of a press-forming apparatus of the present invention will be described in detail below with reference to FIGS. 1 to 9. FIG. 1 is a plan view illustrating the lower press-forming unit of a press-forming apparatus according to an embodiment of the present invention; FIG. 2 is a bottom view illustrating the upper press-forming unit of the press-forming apparatus according to the embodiment of the present invention; FIG. 3 is a cross-sectional view in which the cross-section of the lower press-forming unit cut along the line III—III as shown in FIG. 1 and the cross-section of the upper press-forming unit cut along the line III—III as shown in FIG. 2 are combined to each other; FIG. 4 is a cross-sectional view in which the cross-section of the lower press-forming unit cut along the line IV—IV as shown in FIG. 1 and the cross-section of the upper press-forming unit cut along the line IV—IV as shown in FIG. 2 are combined to each other; FIG. 5(A) is a schematic perspective view illustrating the structure of the first and second subsidiary forming sections of the press-forming apparatus according to the embodiment of the present invention and FIG. 5(B) is a schematic perspective view illustrating a mounting state of the lower forming section of the second subsidiary forming sections; FIGS. 6(A) to 6(C) are descriptive views illustrating a press-forming operation, which is applied to an end area of the material to be press-formed through the press-forming apparatus according to the embodiment of the present invention; FIGS. 7(A) to 7(C) are descriptive views illustrating the press-forming operation, which is applied to a middle portion of the material to be press-formed through the press-forming apparatus according to the embodiment of the present invention; FIGS. 8(A) to 8(C) are descriptive views illustrating the press-forming operation, which is applied to the other end area of the material to be press-formed through the press-forming apparatus according to the embodiment of the present invention; and FIG. 9 is a schematic plan view of a heat transfer member, which is manufactured by the press-forming apparatus according to the embodiment of the present invention.

As shown in each of FIGS. 1 to 9, the press-forming apparatus according to the embodiment of the present invention includes a pair of press-forming units 1, 1, which are detachably secured to a movable unit and a stationary unit that face each other, respectively, so that a metallic thin sheet material 100 to be press-formed, see FIGS. 6A to 6C, which is supplied to the press-forming units 1, 1 in a predetermined feeding direction, subjected to a press-forming through the press-forming units 1, 1 and then discharged therefrom as a heat transfer member for a heat exchanger, which has a predetermined shape. The structural components other than the press-forming units 1, 1 of the press-forming apparatus are known, and description thereof is omitted.

The press-forming units 1, 1 are provided with a pair of main forming sections 10, 10, two pairs of first subsidiary forming sections 20, 30, two pairs of second subsidiary forming sections 40, 50, a pair of forming section-support base members 60, 60, subsidiary forming section-elevating devices 70 for moving up and down the subsidiary forming sections and actuators 80 for the subsidiary forming section-elevating devices 70, and suction support members 90.

The pair of main forming sections 10, 10 form on the material to be press-formed a heat transfer face with corrugated portions, having opposite surfaces, which are to be brought into contact with heat exchange fluids.

Each pair of the first subsidiary forming sections 20, 30 are disposed on the upstream and downstream sides of respective one of the pair of main forming sections 10, 10 so as to be adjacent thereto in the feeding direction of the material to be press-formed.

Each pair of the second subsidiary forming sections 40, 50 are detachably disposed on the opposite sides in the direction perpendicular to the feeding direction of the material to be press-formed, so as to be adjacent to the main forming sections 10, 10.

The upper forming section-support base member 60 is used to support (i) the upper main forming section 10, (ii) the upper first subsidiary forming sections 20, 30 and (iii) the upper second subsidiary forming sections 40, 50. The lower forming section-support base member 60 is used to support the lower main forming sections 10, (ii) the lower first subsidiary forming sections 20, 30 and (iii) the lower second subsidiary forming sections 40, 50.

The subsidiary forming section-elevating devices 70 and the actuators 80 make a positional adjustment of the first subsidiary forming sections 20, 30 in the pressing direction so as to provide switchably a contact mode in which the first subsidiary forming sections 20, 30 come into contact with the material 100 to be press-formed and a non-contact mode in which they do not come into contact with the material 100 to be press-formed.

The suction support members 90 are disposed in two positions on the upstream side of the forming sections on the one of the pair of forming section-support base members 60, 60 in the feeding direction of the material to be press-formed, so as to support, under the sucking operation, the material to be press-formed, which has been supplied between the forming sections.

Each of the main forming sections 10, 10 has a three-part structure composed of a main member 11 and a pair of end members 12. The end members 12, 12 are disposed respectively on the opposite sides of the main member 11 in the feeding direction of the material to be press-formed so as to be adjacent to the main member 11. Each of the end members 12, 12 is provided on the surface thereof with a boundary portion having a predetermined width with patterned corrugations, which are aligned by a predetermined pitch in the perpendicular direction to the feeding direction of the material to be press-formed. The above-mentioned pair of main forming sections 10, 10 having such a three-part structure are secured to the pair of forming section-support base members 60, 60, respectively.

The upper main member 11, i.e., the upper die 11*a* is secured to the upper forming section-support base member 60 so that its pressing-forming face faces downward. The lower main member 11, i.e., the lower die 11*b* is secured to the lower forming section-support base member 60 so that its pressing-forming face faces upward to the upper die 11*a*. The upper end members 12, 12, i.e., the upper dies 12*a*, 12*a* are secured to the upper forming section-support base member 60 so that their press-forming faces face downward. The lower end members 12, 12, i.e., the lower die 12*b*, 12*b* are disposed on the lower forming section-support base member 60 so that their pressing-forming faces face upward to the upper dies 12*a*, 12*a*, respectively. The upper die 11*a* of the main member 11 is integrally formed with upper dies 41, 51 of the second subsidiary forming sections 40, 50. The upper dies 12*a*, 12*a* of the end members 12, 12 are integrally formed with upper dies 21, 31 of the first subsidiary forming sections 20, 30, respectively.

Each of the lower dies 12*b*, 12*b* of the end members 12, 12 is mounted on the lower forming section-support base member 60 through a resilient member 13 so that the press-forming face of the lower die 12*b* projects from the press-forming face of the main member 11 by a predetermined length in a state in which a pressing force is not applied to the material to be press-formed. The resilient member 13 is formed of a sheet of resilient material such as rubber or polyurethane, which has elasticity by which the press-forming face of the lower die 12*b* can be retracted to a place corresponding to the press-forming face of the main member 11.

The first subsidiary forming sections 20, 30 are composed of the upper dies 21, 31, which are secured to the upper forming section-support base member 60 so that their press-forming faces face downward, and the lower dies 22, 32, which are disposed to face the above-mentioned upper dies 21, 31, respectively, so that their press-forming faces face upward. Each of the first subsidiary forming sections 20, 30 is provided with a press-forming face in which a flat portion having a predetermined width is continuously formed and a plurality of recesses and projections are formed so as to be aligned in the perpendicular direction to the feeding direction of the material to be press-formed.

The lower dies 22, 32 of the first subsidiary forming sections 20, 30 are supported on the lower forming section-support base member 60 so as to be adjusted in the pressing direction and provided on the opposite surface to the press-forming face with inclined surfaces having a predetermined inclination angle. Positional adjustment of the subsidiary forming section-elevating device 70, which slidably comes into contact with the above-mentioned inclined surface, makes it possible to provide switchably a pressing state in which the lower dies 22, 32 of the first subsidiary forming sections 20, 30 come into contact with the material 100 to be press-formed, together with the above-mentioned main forming section 10, and a non-pressing state in which the lower dies 22, 32 do not come into contact with the material 100 to be press-formed.

The second subsidiary forming sections 40, 50 are composed of the upper dies 41, 51, which are secured to the upper forming section-support base member 60 so that their press-forming faces face downward, and the lower dies 42, 52, which are disposed to face the above-mentioned upper dies 41, 51, respectively, so that their press-forming faces face upward. The second subsidiary forming sections 40, 50 are symmetrically placed with respect to the central line in the feeding direction of the material to be press-formed. The second subsidiary forming section 40 (50) is provided with the press-forming face in which a projection 44 (54) and a recess 45 (55) are formed and a corrugated portion having a predetermined width is provided excepting the area of the above-mentioned projection 44 (54) and recess 45 (55). The corrugations align in a parallel direction to the feeding direction of the material to be press-formed, thus providing a smooth sine curve in the cross-section. The remaining portions have a flat surface so as to convert predetermined portions of the material 100 to be press-formed into a flange portion 220 of a heat transfer member 200 to be manufactured.

The lower dies 42, 52 of the second subsidiary forming sections 40, 50 are mounted on the lower forming section-support base member 60 through resilient members 43, 53 so that the press-forming faces of the lower dies 42, 52 project from the press-forming face of the main member 11 by a predetermined length in a state in which a pressing force is not applied to the material to be press-formed. The resilient members 43, 53 are formed of a sheet of resilient material such as rubber or polyurethane, which has elasticity by which the press-forming faces of the lower dies 42, 52 can be retracted to a place corresponding to the press-forming face of the main member 11.

The lower dies 42, 52 of the second subsidiary forming sections 40, 50 are provided with pins 46, 56 on the downstream side thereof in the feeding direction of the material to be press-formed, respectively. These pins 46, 56 are retractable from the surfaces of the lower dies 42, 52, respectively. The material 100 to be press-formed, which is supplied between the forming sections in a predetermined position by means of a carrying unit (not shown), comes into contact with the above-mentioned pins 46, 56, thus providing a precise positional determination of the material 100 to be press-formed. Thus, the pins 46, 56 serve as a stopper during the first press-forming step applied to the material 100 to be press-formed. In case where the material 100 to be press-formed is subjected to a plurality of press-forming steps, the pins 46, 56 are retracted from the surfaces of the lower dies 42, 52 by a small force upon movement of the material 100 to be press-formed, which has been subjected to the press-forming step(s), thus preventing the movement of the material 100 to be press-formed.

In addition, the lower dies 42, 52 of the second subsidiary forming sections 40, 50 are provided with guide pins 47, 57, which control the movement of the material 100 to be press-formed in the perpendicular direction to the feeding direction of the material 100 to be press-formed. Even when the material 100 to be press-formed is relatively long, these guide pins 47, 57 keep the material 100 to be press-formed in a proper position in cooperation with the other guide pins provided in the forming section-support base member 60, thus providing a stable press-forming operation for the material 100 to be press-formed. Even when the material 100 to be press-formed has a winding shape, the adjustment of these guide pins causes a proper positional determination of the material 100 to be press-formed relative to the forming sections.

The lower forming section-support base member 60 is provided with the subsidiary forming section-elevating devices 70, the actuators 80 and the suction support members 90, in addition to the respective forming sections. Further, the lower forming section-support base member 60 is provided, on the upstream side (i.e., the feeding side) of the lower dies 42, 52 of the second subsidiary forming section 40, 50 in the feeding direction of the material to be press-formed, with additional guide pins 61. These additional guide pins 61 are placed in four positions of the lower forming section-support base member 60, which define a square area thorough which the material 100 to be press-formed is to pass, so as to control the movement of the material 100 to be press-formed in the perpendicular direction to the feeding direction thereof. When the material 100 to be press-formed is relatively long, the six guide pins including the guide pins provided in the second subsidiary forming section keep the material 100 to be press-formed in a proper position.

In addition, the lower forming section-support base member 60 is provided, on the downstream side (i.e., the discharging side) of the second subsidiary forming sections 40, 50 in the feeding direction of the material to be press-formed, with projections 62 and recesses 63, which are similar to the above-described projections 44, 45 and recesses 45, 55 of the second subsidiary forming sections 40, 50. The distance between the projection 62 and the recess 63 is equal to the distance between the above-described projection 44 and recess 45. These projections 62 and recesses 63 are displaced from the projections 44, 45 and recesses 45, 55 of the second subsidiary forming sections 40, 50 by a distance corresponding to the feeding amount of the material to be press-formed for a single press-forming operation. In case where the material 100 to be press-formed is subjected to a plurality of press-forming steps, the material 100 to be press-formed, which has been subjected to a single press-forming step to provide a projection and a recess formed thereon, is transferred to the next position so that the thus formed projection and recess are precisely fitted into the recess 63 and the projection 62 of the forming section-support base member 60, thereby making a precise positional determination of the material 100 to be press-formed.

The subsidiary forming section-elevating devices 70 are disposed on the lower forming section-support base member 60 on the rear side of the lower dies 22, 32 of the first subsidiary forming sections 20, 30 in the pressing direction, so as to be movable in the horizontal direction. Each of the subsidiary forming section-elevating devices 70 includes a wedge-shaped member, which has on the front side in the pressing direction an inclined surface having the same inclination angle of the inclined surface of the above-described lower dies 22, 32. The wedge-shaped member comes slidably into contact with the lower die 22, 32 to convert the horizontal motion of the wedge-shaped member into the vertical motion of the lower die 22, 32 through the above-mentioned inclined surface.

The actuators 80 are disposed on the lower forming section-support base member 60 so as to be adjacent to the respective subsidiary forming section-elevating devices 70. Any one of the actuators 80 moves the subsidiary forming section-elevating device 70 in the horizontal direction by a predetermined stroke. A known air-cylinder is for example used as the actuator 80.

The suction support members 90 are disposed on the lower forming section-support base member 60 on the upstream side of the first subsidiary forming section 30 in the feeding direction of the material 100 to be press-formed. A known vacuum suction cup or pad may be used as the suction support member 90 so that the tip portion thereof is placed in the same level as the press-forming face of the main member 11 of the main forming section. The suction support members 90 hold the material 100 to be press-formed at the lower surface thereof under a sucking action. In case where the material 100 to be press-formed is ferrous, a device for providing an electromagnetic sucking action, such as an electromagnet may be used as the suction support member 90.

The main member 11 and the end members 12, of which the main forming section 10 is composed, the first subsidiary forming sections 20, 30 and the second subsidiary forming sections 40, 50 are detachably disposed on the forming section-support base member 60. These structural elements may be changed to the other elements having the different press-forming face in accordance with the press-forming conditions, thus making it possible to provide the material 100 to be press-formed with an appropriate shape for the heat transfer member 200.

Detection devices (not shown) for determining as whether or not an area to be press-formed of the material 100 reaches a predetermined position where the press-forming step is carried out by the forming sections, are disposed in the vicinity of the first subsidiary forming sections 20, 30 and the second subsidiary forming sections 40, 50.

The material 100 to be press-formed, which is a metallic thin sheet having a rectangular shape, is supplied into the press-forming apparatus in the single feeding direction to be converted into the heat transfer member 200 with corrugated portions, in which the heat transfer face 210 having the opposite surfaces that are to be brought into contact with heat exchange fluids is formed in the central portion by a plurality of press-forming steps utilizing the main forming sections 10, on the one hand, and the flange portion 220 is formed so as to surround the heat transfer face 210, on the other hand (see FIG. 9). The heat transfer face 210 serves as the zone, which has the predetermined corrugations that are optimized to bring the opposite surfaces of the heat transfer face 210 into contact with the high and low temperature fluids, respectively, to achieve the heat transfer.

Now, description will be given below of a press-forming operation applied to the material 100 to be press-formed, utilizing the press-forming apparatus according to the embodiment of the present invention. The description will be given on the assumption that any defects of the materials 100 to be press-formed have been detected in an appropriate manner and only the materials 100 having no defects are supplied to the press-forming step.

First, the press-forming step utilizing the first subsidiary forming sections 20, which is placed on the most downstream side in the feeding direction of the material 100 to be press-formed, the main forming sections 10 and the second subsidiary forming sections 40, 50 is carried out. The sliding action of the forming section-elevating device 70, which is caused by the actuator 80, causes the lower die 32 of the first subsidiary forming section 30 to descend relative to the other lower dies 12*b*, 22, 42, 52, in the initial state in which the upper and lower dies of the respective forming sections are apart from each other. Then, the carrying unit (not shown) transfers the material 100 to be press-formed into the press-forming apparatus so that one end of the material 100 to be press-formed is inserted between the upper and lower dies.

When the one end of the material 100 to be press-formed reaches the predetermined position where the press-forming step is carried out, the feeding step of the material 100 is temporarily stopped. The suction support members 90 come into contact with the lower surface of the material 100. After there is ensured a state in which the suction support members 90 hold the material 100 under a sucking action, the carrying unit releases the material 100 and moves away from the supper and lower dies. Even when the material 100 is relatively long, the suction support members 90 hold the portion of the material 100, which extends from the dies upstream in the feeding direction of the material 100 and has not as yet been subjected to the press-forming step, under the sucking action, so as to keep the material 100 stable and stationary, thus preventing the material 100 from unfavorably moving, irrespective of release of the material 100 from the carrying unit. Consequently, the subsequent press-forming step can be carried out with high accuracy.

When there is ensured a state in which only the material 100 exists between the upper and lower dies (see FIG. 6(A)), the respective upper dies of the forming sections descend toward the corresponding lower dies thereof. The end members 12 in which the lower die 12*b* projects relative to the main member 11, and the second subsidiary forming sections 40, 50 come first into contact with the material 100 so as to make a positional determination of the material 100, thus preventing an unfavorable deviation thereof (see FIG. 6(B)). Further descending the upper dies toward the corresponding lower dies causes the lower dies 12*b* of the end members 12 and the lower dies 42, 52 of the second subsidiary forming sections 40, 50 to descend due to elastic deformation of the resilient members 13, 43, 53 so that the remaining dies also come into contact with the material 100. When the maximum pressing force is applied to the material 100, the lower dies 12*b* of the end members 12 and the lower dies 42, 52 of the second subsidiary forming sections 40, 50 are placed in the same level as the main member 11. Accordingly, the material 100 is pressed by means of the main members 11, the end members 12 and the second subsidiary forming sections 40, 50 (see FIG. 6(C)).

The one end of the material 100 is held by the main forming sections 10, the first subsidiary forming section 20 and the second subsidiary forming sections 40, 50 and then a uniform pressure is applied to the material 100 to form the predetermined press-formed portion according to the respective dies on the material 100. At this stage, the lower die 32 of the first subsidiary forming section 30 is further away from the material 100 than the remaining dies and does not come into contact with the material 100 at all, with the result that the press-forming step utilizing the first subsidiary forming section 20 is not carried out. The suction support members 90 halt the sucking action to release the material 100 when the respective dies come into contact with the material 100. After completion of the press-forming step of the one end area of the material 100, all the upper dies ascend so as to be away from the corresponding lower dies. The feeding step of the material 100 is carried again by means of the carrying unit.

The press-formed portion of the material 100 obtained by the main forming sections 10 includes the central press-formed portion caused by the main corrugation patterned portion of the main member 11 and the press-formed portions that are placed on the opposite side of the central press-formed portion and formed by means of the boundary patterned portions of the end members 12. The portions of the material 100, which is adjacent to the non-pressed portion, are subjected to the press-forming step utilizing the end members 12 to provide a press-formed portion in which the corrugations based on the boundary pattern are uniformly formed in the perpendicular direction to the feeding direction of the material 100. Substantially the same condition in the drawing of the material from the non-pressed portion to the pressed portion is provided in the respective boundary between the pressed portion and the non-pressed portion, thus avoiding residual strain in any one of the pressed portion and the non-pressed portion of the heat transfer member after completion of the press-forming step.

Then, the press-forming step is carried out only with the use of the main forming sections 10 and the second subsidiary forming sections 40, 50. The sliding action of the forming section-elevating device 70, which is caused by the actuator 80, causes the respective lower dies 22, 32 of the first subsidiary forming sections 20, 30 to descend relative to the other lower dies 12*b*, 42, 52, in the initial state in which the upper and lower dies of the respective forming sections are apart from each other. Then, the carrying unit (not shown) transfers the material 100 to be press-formed into the press-forming apparatus so that the subsequent area to be press-formed of the material 100 is inserted between the respective upper and lower dies (see FIG. 7(A)).

The subsequent area to be press-formed of the material 100 includes the corrugation patterned portions, which have been provided by the boundary patterned portions that are placed on the upstream side in the feeding direction of the material 100, of the press-formed portions as already obtained. As a result, the above-mentioned corrugation patterned portions are subjected again to the press-forming step utilizing the end member 12 that is placed on the downstream side in the feeding direction of the material 100.

When the subsequent area to be press-formed of the material 100 reaches the predetermined position where the press-forming step is carried out, also in the press-forming operation utilizing the main forming sections 10 and the second subsidiary forming sections 40, 50, the feeding step of the material 100 is temporarily stopped in the same manner as described above. The suction support members 90 come into contact with the lower surface of the material 100 and the carrying unit moves away from the upper and lower dies. When there is ensured a state in which only the material 100 exists between the upper and lower dies, the respective upper dies of the forming sections descend toward the corresponding lower dies thereof. The end members 12 and the second subsidiary forming sections 40, 50 come first into contact with the material 100 and the press-forming step is started, and the subsequent area of the material 100 is then subjected to the press-forming step utilizing the main forming sections 10, the first subsidiary forming section 20 and the second subsidiary forming sections 40, 50 so that a uniform pressure is applied to the material 100 to form the predetermined press-formed portion according to the respective dies on the material 100. At this stage, the lower dies 22, 32 of the first subsidiary forming sections 20, 30 are further away from the material 100 than the remaining dies and do not come into contact with the material 100 at all, with the result that the press-forming step utilizing the first subsidiary forming sections 20, 30 is not carried out.

After completion of the above-mentioned press-forming step, all the upper dies ascend so as to be apart from the corresponding lower dies. The feeding step of the material 100 is carried out again by means of the carrying unit so that the further subsequent area to be press-formed of the material 100 reaches the predetermined position where the press-forming step is carried out. The upper dies of the forming sections descend again toward the corresponding lower dies of the forming sections in the same manner as described above, thus applying the further subsequent press-forming step to the material 100.

A set of the feeding step of the material 100 and the series of press-forming steps as described above is repeated by the predetermined number of times, which is identical to the number of areas to be press-formed of the material 100 so that the press-forming steps are applied to the material 100 while feeding the material 100 by a predetermined distance after completion of the single press-forming step. As a result, there is obtained the press-formed portions caused by the main forming sections 10 and the second subsidiary forming sections 40, 50, which portions are aligned in the longitudinal direction of the material 100.

During the plurality of press-forming steps utilizing the main forming sections 10 and the second subsidiary forming sections 40, 50, the press-formed portion of the material 100, which has been provided by the boundary patterned portions, of the press-formed portions thereof obtained by the preceding press-forming step, is subjected again to the press-forming step utilizing the end member 12 that is placed on the downstream side in the feeding direction of the material 100. Accordingly, the material 100 is press-formed into a semi-finished sheet, which is provided with the press-formed portion that has a plurality of sets of corrugations aligning in the feeding direction of the material 100 and has a shape in accordance with the main patterned portion of the main members 11, on the one hand, and the single press-formed portion, which is adjacent to the above-mentioned press-formed portion and has a shape in accordance with the boundary patterned portions of the end members 12.

After completion of the press-forming steps utilizing the main forming sections 10 and the second subsidiary forming sections 40, 50 by the predetermined number of times, the material 100 is subjected to the last press-forming step utilizing the first subsidiary forming sections 30, which is placed on the most upstream side in the feeding direction of the material 100, the main forming sections 10 and the second subsidiary forming sections 40, 50. The sliding action of the forming section-elevating device 70, which is caused by the actuator 80, causes the lower die 22 of the first subsidiary forming section 20 to descend relative to the other lower dies 12*b*, 32, 42, 52, in the initial state in which the upper and lower dies of the respective forming sections are apart from each other. Then, the carrying unit (not shown) transfers the material 100 to be press-formed into the press-forming apparatus so that the other end of the material 100 to be press-formed is inserted between the upper and lower dies.

When the other end of the material 100 to be press-formed reaches the predetermined position where the press-forming step is carried out, the feeding step of the material 100 is temporarily stopped in the same manner as described above. The suction support members 90 come into contact with the lower surface of the material 100 and the carrying unit moves away from the upper and lower dies. When there is ensured a state in which only the material 100 exists between the upper and lower dies (see FIG. 8(A)), the respective upper dies of the forming sections descend toward the corresponding lower dies thereof. The other end of the material 100 is then subjected to the press-forming step utilizing the main forming sections 10, the first subsidiary forming section 30 and the second subsidiary forming sections 40, 50 so that a uniform pressure is applied to the material 100 to form the predetermined press-formed portion according to the respective dies on the material 100. At this stage, the lower dies 22 of the first subsidiary forming sections 20 are further away from the material 100 than the remaining dies and do not come into contact with the material 100 at all, with the result that the press-forming step utilizing the first subsidiary forming sections 20 is not carried out.

During the above-described last press-forming step, the press-formed portion of the material 100, which has been provided by the boundary patterned portions, of the press-formed portions thereof obtained by the preceding press-forming step, is also subjected again to the press-forming step utilizing the end member 12 that is placed on the upstream side in the feeding direction of the material 100.

After completion of the press-forming steps utilizing the main forming sections 10, the first subsidiary forming sections 30 and the second subsidiary forming sections 40, 50, the respective upper dies of the forming sections ascend so as to be away from the corresponding lower dies. The carrying unit (not shown) holds the material 100 and moves it in the feeding direction thereof to discharge the material 100 from the upper and lower dies. The material 100 as press-formed is transferred as the heat transfer member 200 and then subjected to the subsequent steps.

According to the press-forming apparatus of the embodiment of the present invention, the material 100 to be press-formed is subjected to the press-forming step utilizing the main forming sections 10, the first subsidiary forming sections 20, 30 and the second subsidiary forming sections 40, 50, which are aligned in the feeding direction of the material 100 to be press-formed, to form the different patterns of corrugations on the material 100 to be press-formed, thus providing the heat transfer member 200. Particularly, it is possible to form, as an occasion demands, flat portions or corrugations on the peripheral portion of the material to be press-formed with the use of the first subsidiary forming sections 20, 30 and the second subsidiary forming sections 40, 50 so as to impart predetermined functions to the heat transfer member 200, thus providing the heat transfer members, which cope with many intended uses. Even when the material 100 to be press-formed is relatively long, it is possible to apply the press-forming steps to the material 100 to be press-formed, while selectively utilizing the first subsidiary forming sections 20, 30, so as to form the heat transfer face 210 and/or the other press-formed portions on the entirety of the heat transfer member 200, thus enabling the formation of the heat transfer face 210 having the larger size of the die. The lower dies of the end members 12 which are the components of the main forming section, and the lower dies of the second subsidiary forming sections 40, 50 are disposed through the resilient members 13, 43, 53 on the lower forming section-support member 60 so as to project from the main member 11 of the main forming section. Consequently, the above-mentioned lower dies come into contact with the material 100 to be press-formed prior to the contact of the main member 11 therewith when starting the press-forming operation. It is therefore possible to hold the material 100 to be press-formed in a proper position, thus providing a formation of the heat transfer face utilizing the main forming section with high accuracy.

In addition, according to the press-forming apparatus of the embodiment of the present invention, the subsidiary forming section-elevating devices 70, which are provided on the front side in the pressing direction through the first subsidiary forming section 20, 30 with the inclined surfaces, are disposed so as to be movable in the horizontal direction, and sliding the subsidiary forming section-elevating device 70 in the horizontal direction by the actuator 80, while bring them into contact with the first subsidiary forming section 20, 30, enables the first subsidiary forming section 20, 30 to be shifted. The subsidiary forming section-elevating device 70 having the wedge shape bears a strong force applied to the first subsidiary forming section 20, 30 during the press-forming operation so as to reduce a reaction force to be applied to the actuator 80. As a result, it is possible to lightening the load of the actuator 80 more remarkably than the case where the actuator 80 is disposed directly on the rear side in the pressing force. The actuator 80 for shifting the fist subsidiary forming section 20, 30 can be made small-sized and inexpensive. In addition, no specific positional adjustment mechanism having a complicated structure is provided directly in the pressing direction, thus decreasing the whole height of the apparatus.

In the above-described embodiment of the present invention, the second subsidiary forming sections 40, 50 and the main forming sections 10 always contribute all the press-forming steps as applied. There may however be adopted a structure in that the lower dies 42, 52 of the second subsidiary forming sections 40, 50 are adjustable along the pressing direction for the predetermined area of the material 100 to be press-formed, in the same manner as the first subsidiary forming sections 20, 30. The pressing steps may be applied, while keeping the second subsidiary forming sections 40, 50 away from the material 100 to be press-formed, so as to provide no press-formed portion through the second subsidiary forming sections 40, 50.

In the above-described embodiment of the present invention, the plurality of press-forming steps utilizing the main forming sections 10 is applied to the material 100 to be press-formed, thus forming the heat transfer member 200 in which the press-formed portions are aligned. The press-forming step simultaneously utilizing the main forming sections 10 and the first subsidiary forming sections 20, 30 may be applied to a heat transfer member, which includes the single press-formed portion based on the main forming sections 10. Such an optional feature is suitable to manufacture a heat transfer member 200 having a small area for a small-sized heat exchanger.

In the above-described embodiment of the present invention, the portion of the material 100 to be press-formed, which is located on the upstream side in the feeding direction of the material 100 to be press-formed, is subjected twice to the press-forming step utilizing the end members 12 of the main forming sections. It may be adopted a structure in which the feeding length of the material 100 to be press-formed is adjusted so that only the portion of the material that has not as yet been subjected to the press-forming step is subjected to the press-forming step.

In the above-described embodiment of the present invention, the forming sections form the elongated heat transfer face in the perpendicular direction to the feeding direction of the material to be press-formed by the single press-forming step, and the plurality of press-forming steps utilizing the respective forming sections is applied, while making positional adjustment of the respective lower dies of the first subsidiary forming sections 20, 30, to form the heat transfer member 200 in which the press-formed portions align in the feeding direction of the material to be press-formed, as an occasion demands. The respective dies may be modified to form an elongated heat transfer face in the feeding direction of the material to be press-formed (corresponding to a case in which a set of the respective dies in the above-described embodiment is turned by 90 degrees), and one or more press-forming step may be applied, while making positional adjustment of the subsidiary forming sections, which are located on the upstream and downstream sides in the feeding direction of the material to be press-formed, as an occasion demands, thus providing a heat transfer member 200 suitable for the intended uses.

In the above-described embodiment of the present invention, the main forming section 10 has the divided structure so that the end members 12 of the main forming section 10 is shiftable, thus being brought into contact with the material 100 to be press-formed prior to the contact of the main member 11 therewith when starting the press-forming operation so as to hold the material to be press-formed, while making a positional determination thereof. There may be adopted a structure in which portions of the main member 11, which are adjacent to the second subsidiary forming sections 40, 50 or correspond to one or more positions of the patterned portion with corrugations, which align by a predetermined pitch, are supported on the forming section-support member 60 through resilient members, so as to be movable relative to the remaining portions of the main member 11. According to such additional features, it is possible to make a more precise positional determination of the material 100 to be press-formed during the press-forming step, thus further improving the press-formability of the material 100 to be press-formed. The remaining portions of the main member 11 may be movable along the pressing direction by mounting one or all of the divided parts on the forming section-support member 60 through the resilient member 13. Alternatively, the elastic members having different elasticity from each other may be disposed between the respective dies and the forming section-support member 60. Such additional features make it possible to form various pattern of corrugations for the heat transfer face 210.

According to the features of the first aspect of the present invention as described in detail, the material to be press-formed is subjected to the press-forming step utilizing the main forming sections and the first subsidiary forming sections, which are aligned in the feeding direction of the material to be press-formed, to form the different patterns of corrugations on the material to be press-formed, thus providing a heat transfer member. Particularly, it is possible to form, as an occasion demands, flat portions or corrugations on the peripheral portion of the material to be press-formed so as to impart predetermined functions to the heat transfer member, thus providing the heat transfer members, which cope with many intended uses. Even when the material to be press-formed is relatively long, it is possible to apply the press-forming steps to the material to be press-formed, while selectively utilizing the first subsidiary forming sections, so as to form the heat transfer face and/or the other press-formed portions on the entirety of the heat transfer member, thus enabling the formation of the heat transfer face having the larger size of the die. The single press-forming step utilizing the main forming sections makes it possible to provide a state in which the press-formed portions with corrugations given by the boundary patterned portions, which are located in the front and rear sides in the feeding direction of the material to be press-formed, are aligned in the perpendicular direction to the feeding direction of the material to be press-formed. Accordingly, the end portions of the material to be press-formed can be provided with substantially the uniform press-forming conditions, irrespective of arrangement of the main corrugation pattern portion of the main member. Substantially the same condition in the drawing of the material from the non-pressed portion to the pressed portion is provided in the respective boundary between the pressed portion and the non-pressed portion, thus avoiding residual strain in any one of the pressed portion and the non-pressed portion of the heat transfer member after completion of the press-forming step. It is therefore possible to prevent an unfavorable deformation of the heat transfer member as the finished product, due to residual strain.

According to the features of the second aspect of the present invention, each of the pair of main forming sections has the divided structure, which comprises the main member and the pair of end members, the end members of one of the pair of main forming sections are mounted on the forming section-support base member thorough the resilient members so as to come into contact with the material to be press-formed prior to the contact of the main member therewith, and the application of the maximum pressing force causes the main member and the end members to be urged on the material to be press-formed. It is therefore possible to bring the end members of the main forming section into initial contact with the material to be press-formed to hold the material in a proper position, thus providing a formation of the heat transfer face utilizing the main forming section with high accuracy.

According to the features of the third aspect of the present invention, the subsidiary forming section-elevating devices, which are provided on the front side in the pressing direction through the first subsidiary forming section with the inclined surface, are disposed so as to be movable in the horizontal direction, and sliding the subsidiary forming section-elevating device in the horizontal direction by the actuator, while bring them into contact with the first subsidiary forming section, enables the first subsidiary forming section to be shifted. The subsidiary forming section-elevating device having the wedge shape bears a strong force applied to the first subsidiary forming section during the press-forming operation so as to reduce a reaction force to be applied to the actuator. As a result, it is possible to lightening the load of the actuator more remarkably than the case where the actuator is disposed directly on the rear side in the pressing force. The actuator for shifting the fist subsidiary forming section can be made small-sized and inexpensive. In addition, no specific positional adjustment mechanism having a complicated structure is provided directly in the pressing direction, thus decreasing the whole height of the apparatus.

According to the features of the fourth aspect of the present invention, the secondary subsidiary forming sections are disposed on the opposite sides in the direction perpendicular to the feeding direction of the material to be press-formed on the forming section-support base member, so as to be adjacent to the main forming section, and the second subsidiary forming sections for one of the pair of press-forming units are mounted through the resilient members so as to project from the press-forming face of the main forming section so that the second subsidiary forming sections come into contact with the material to be press-formed prior to the contact of the main member therewith. In addition, the predetermined press-formed portions can be formed by the second subsidiary forming sections so as to align with the heat transfer face. It is therefore possible to provide the portions of the material to be press-formed in the perpendicular direction of the feeding direction of the material with desired functions, thus flexibly coping with many intended uses. It is possible to bring the second subsidiary forming sections into initial contact with the material to be press-formed to hold the material in a proper position, thus providing a formation of the heat transfer face utilizing the main forming section with high accuracy.

According to the features of the fifth aspect of the present invention, the suction support members are disposed in the predetermined positions on the upstream side of the first subsidiary forming section on the forming section-support base member in the feeding direction of the material to be press-formed so as to hold the portion of the material to be press-formed, which extends from the dies upstream in the feeding direction of the material and has not as yet been subjected to the press-forming step, under the sucking action, even when the material to be press-formed is relatively long. The material to be press-formed can be kept stably and stationary, thus preventing the material from unfavorably moving, irrespective of release of the material from the carrying unit.

What is claimed is:

1. A press-forming apparatus comprising a pair of press-forming units, which are detachably secured to a movable unit and a stationary unit that face each other, respectively, so that a metallic thin sheet material to be press-formed, which is supplied to the press-forming units in a predetermined feeding direction, subjected to a press-forming through the press-forming units and then discharged there from as a heat transfer member for a heat exchanger, said heat transfer member having a predetermined shape, wherein:

each of said press-forming units comprises (i) a main forming section for forming on the material to be press-formed a heat transfer face with a corrugated portion, which has opposite surfaces to be brought into contact with heat exchange fluids, (ii) a pair of first subsidiary forming sections, which are each disposed on upstream and downstream sides of said main forming section so as to be adjacent thereto in the feeding direction of the material to be press-formed, said pair of first subsidiary forming sections of one of said press-forming units respectively facing said pair of first subsidiary forming sections of another of said press-forming units to form an upstream set of first subsidiary forming sections and an downstream set of first subsidiary forming sections in the feeding direction of the material to be press-formed and (iii) a forming section-support base member detachably supporting said main forming section and said pair of first subsidiary forming sections;

said main forming section having a press-forming face on which there are formed main corrugation patterned portions that are symmetric with respect to a central line, which is perpendicular to the feeding direction of the material to be press-formed, on one hand, and boundary patterned portions having a predetermined width, on which a plurality of recesses and projections align in a direction perpendicular to the feeding direction of the material to be press-formed, on the other hand; and one of said upstream set of first subsidiary forming sections and one of said downstream set of first subsidiary forming sections being adjustable to shift press-forming faces thereof along a pressing direction, so as to provide switch ably a contact mode in which said press-forming faces come into contact with the material to be press-formed together with the main forming section to apply a press-forming operation to the material to be press-formed and a non-contact mode in which the press-forming operation is not applied thereto.

2. The apparatus as claimed in claim 1, wherein:

each of said pair of main forming sections has a divided structure, which comprises a main member having on a surface thereof said main corrugated patterned portions and a pair of end members having on a surface thereof boundary patterned portions;

said pair of end members of one of said pair of main forming sections are mounted on the forming section-support base member through predetermined resilient members so as to project from a press-forming face of said main member by a predetermined length in a state in which a pressing force is not applied to the material to be press-formed; and said resilient members have elasticity by which press-forming faces of said end members are retracted to a place corresponding to the press-forming face of the main member when a maximum pressing force is applied to the material to be press-formed.

3. The apparatus as claimed in claim 1 or 2, further comprising:

subsidiary forming section-elevating devices having a wedge-shape, which are disposed on the forming section-support base member on a rear side of said pair of first subsidiary forming sections in the pressing direction, so as to be movable in a horizontal direction, each of said subsidiary forming section-elevating devices having on a front side in the pressing direction an inclined surface having a predetermined inclination angle; and actuators for moving said subsidiary forming section-elevating devices in the horizontal direction, said one of said upstream set of first subsidiary forming sections and said one of said downstream set of first subsidiary forming sections being supported on the forming section-support base member so as to be adjusted along the pressing direction, each of said pair of first subsidiary forming sections being provided on an opposite surface to its press-forming face with an inclined surface having a same inclination angle as that of the inclined surface of said subsidiary forming section-elevating device.

4. The apparatus as claimed in any one of claims 1 to 2, further comprising:

a pair of second subsidiary forming sections for each of said pair of press-forming units, said secondary subsidiary forming sections being detachably disposed on opposite sides in a direction perpendicular to the feeding direction of the material to be press-formed on the forming section-support base member, so as to be adjacent to the main forming section, said pair of second subsidiary forming sections for one of said pair of press-forming units being mounted on the forming section-support base member through predetermined resilient members so as to project from the press-forming face of said main forming section by a predetermined length in a state in which a pressing force is not applied to the material to be press-formed; and said resilient members having elasticity by which press-forming faces of said second subsidiary forming sections are retracted to a place corresponding to the press-forming face of the main forming section when a maximum pressing force is applied to the material to be press-formed.

5. The apparatus as claimed in any one of claims 1 to 2, further comprising:

suction support members being disposed in positions on an upstream side of the first subsidiary forming section on one of the forming section-support base members in the feeding direction of the material to be press-formed, so as to support, under a sucking operation, the material to be press-formed, which is supplied between the forming sections while keeping one end of the material to be press-formed in substantially the same level as the press-forming face of said main forming section.

6. The apparatus as claimed in claim 3, further comprising:

a pair of second subsidiary forming sections for each of said pair of press-forming units, said secondary subsidiary forming sections being detachably disposed on opposite sides in a direction perpendicular to the feeding direction of the material to be press-formed on the forming section-support base member, so as to be adjacent to the main forming section, said pair of second subsidiary forming sections for one of said pair of press-forming units being mounted on the forming section-support base member through predetermined resilient members so as to project from the press-forming face of said main forming section by a predetermined length in a state in which a pressing force is not applied to the material to be press-formed; and said resilient members having elasticity by which press-forming faces of said second subsidiary forming sections are retracted to a place corresponding to the press-forming face of the main forming section when a maximum pressing force is applied to the material to be press-formed.

7. The apparatus as claimed in claim 3, further comprising:

suction support members being disposed in positions on an upstream side of the first subsidiary forming section on one of the forming section-support base members in the feeding direction of the material to be press-formed, so as to support, under a sucking operation, the material to be press-formed, which is supplied between the forming sections while keeping one end of the material to be press-formed in substantially the same level as the press-forming face of said main forming section.

8. The apparatus as claimed in claim 4, further comprising:

suction support members being disposed in positions on an upstream side of the first subsidiary forming section on one of the forming section-support base members in the feeding direction of the material to be press-formed, so as to support, under a sucking operation, the material to be press-formed, which is supplied between the forming sections while keeping one end of the material to be press-formed in substantially the same level as the press-forming face of said main forming section.

9. The apparatus as claimed in claim 2, wherein said boundary patterned portions are located in the front and rear sides in the feeding direction of the material to be press-formed and are aligned in the perpendicular direction to the feeding direction of said material to be press-formed.

10. The apparatus as claimed in claim 2, where said end members of said main forming sections are disposed respectively on the opposite sides of the main member in the feeding direction of the material to be press-formed so as to be adjacent to the main member.

11. The apparatus as claimed in claim 2, wherein said boundary portions have a predetermined width with patterned corrugations.

* * * * *